US010156004B2

(12) United States Patent
Bruhnke et al.

(10) Patent No.: US 10,156,004 B2
(45) Date of Patent: Dec. 18, 2018

(54) ALUMINUM-FREE MAGNESIUM ALLOY

(71) Applicant: Ulrich Bruhnke, Ehningen (DE)

(72) Inventors: Ulrich Bruhnke, Ehningen (DE); Ralf Anderseck, Rudelzhausen (DE)

(73) Assignee: Ulrich Bruhnke, Ehningen (DE)

( * ) Notice: Subject to any disclaimer, the term of this patent is extended or adjusted under 35 U.S.C. 154(b) by 336 days.

(21) Appl. No.: 14/783,579

(22) PCT Filed: Apr. 8, 2014

(86) PCT No.: PCT/DE2014/000178
§ 371 (c)(1),
(2) Date: Oct. 9, 2015

(87) PCT Pub. No.: WO2014/166473
PCT Pub. Date: Oct. 16, 2014

(65) Prior Publication Data

US 2016/0060733 A1 Mar. 3, 2016

(30) Foreign Application Priority Data

Apr. 10, 2013 (DE) ..... 10 2013 006 169

(51) Int. Cl.
*C22C 23/00* (2006.01)
*C22C 23/06* (2006.01)
*C22F 1/06* (2006.01)

(52) U.S. Cl.
CPC ..... *C22C 23/00* (2013.01); *C22C 23/06* (2013.01); *C22F 1/06* (2013.01)

(58) Field of Classification Search
CPC ..... C22C 23/00; C23C 23/06; C22F 1/06
USPC ..... 420/405
See application file for complete search history.

(56) References Cited

U.S. PATENT DOCUMENTS

| | | | | |
|---|---|---|---|---|
| 3,240,593 A | 3/1966 | Schneider et al. | | |
| 3,469,974 A | 9/1969 | Ziegler et al. | | |
| 5,681,403 A | 10/1997 | Makino et al. | | |
| 5,811,058 A | 9/1998 | Baba et al. | | |
| 6,264,762 B1 | 7/2001 | Bommer et al. | | |
| 8,435,444 B2 * | 5/2013 | Stolfig | B23K 35/0261 | 420/405 |
| 9,023,228 B2 * | 5/2015 | Schildmann | B44C 1/227 | 216/83 |
| 2010/0112287 A1 * | 5/2010 | Naritomi | B32B 7/12 | 428/143 |

FOREIGN PATENT DOCUMENTS

| | | |
|---|---|---|
| CN | 101956111 A | 1/2011 |
| CN | 101994047 A | 3/2011 |
| CN | 102776427 | 11/2012 |
| DE | 679 156 | 7/1939 |
| DE | 806055 | 6/1951 |
| DE | 1 433 108 | 10/1968 |
| DE | 42 08 504 | 9/1993 |
| DE | 44 46 898 | 7/1996 |
| DE | 196 38 764 | 3/1998 |
| DE | 199 15 276 | 10/2000 |
| DE | 697 04 801 | 8/2001 |
| DE | 10 2009 038 449 | 2/2011 |
| DE | 102011112561 A1 | 3/2013 |
| WO | WO-2013/034134 | 3/2013 |

OTHER PUBLICATIONS

Friedrich, H. E.; Mordike, B. L.: Magnesium Technology—Metallurgy, Design Data, Applications. Berlin, Heidelberg: Springer-Verlag, 2006. pp. 88, 89, 96, 97, 116-118.—ISBN 3-540-20599-3.

* cited by examiner

*Primary Examiner* — Jie Yang
(74) *Attorney, Agent, or Firm* — Smartpat PLC

(57) ABSTRACT

The aluminum-free magnesium alloy has a composition of at least 87.5 wt. % magnesium, produced by adding 0.5 to 2.0 wt. % cerium, 0.2 to 2.0 wt. % lanthanum, 0 to 5 wt. % of at least one further metal from the group of the rare earths, 1.5 to 3.0 wt. % of a manganese compound, and 0 to 0.5 wt. % of a phosphorus compound.

12 Claims, No Drawings

ALUMINUM-FREE MAGNESIUM ALLOY

BACKGROUND OF THE INVENTION

The invention relates to an aluminum-free magnesium alloy and to the use for producing extruded semi-finished products or components and metal sheets.

Magnesium alloys are lightweight construction materials that, compared to alloys of other metals, have a very low weight and are used where a low weight plays an important role, in particular in automotive engineering, in engine construction, and in aerospace engineering.

Offering very good strength properties and low specific weight, magnesium alloys are of great interest as metallic construction materials most notably for vehicle and aircraft construction.

A reduction in weight is needed especially in vehicle construction since additional elements are being installed, due to rising comfort and safety standards. Lightweight construction is also important for the design of energy-saving vehicles. In terms of processing magnesium materials, methods involving metal forming by way of extrusion, forging, rolling, stretch forming or deep drawing are gaining importance. These methods allow lightweight components to be produced, for which demand is growing especially in vehicle construction.

Alloys having advantageous mechanical properties, and more particularly having high tensile strength, are included in the related art.

A magnesium alloy is known from DE 806 055 which is characterized by a composition of 0.5 to 10% metals from the group of rare earths, the remainder being magnesium, with the proviso that the rare earths comprise at least 50%, and more preferably at least 75%, neodymium, and no more than 25% lanthanum and cerium, separately or together, and praseodymium, and small amounts of samarium and traces of the elements of the yttrium group as the remainder, to which is added one or more of the following elements: manganese, aluminum, calcium, thorium, mercury, beryllium, zinc, cadmium and zirconium.

A magnesium alloy containing 2 to 8% rare earth metals is known from DE 42 08 504 A1, wherein the rare earth metal consists of samarium.

Further known magnesium alloys having advantageous mechanical properties comprise alloys containing zinc and mixtures of rare earth metals that have a high content of cerium. Such an alloy contains approximately 4.5 wt. % zinc, and approximately 1.0 wt. % rare earths having a high content of cerium. These alloys can achieve good mechanical properties but they are difficult to cast, making it difficult to cast parts of satisfactory quality. Welding may meet with difficulty if complicated assembled parts are involved.

Magnesium alloys having higher contents of other metal components, such as aluminum and zinc, which solidify with a fine-grained structure, have considerably worse corrosion properties than pure magnesium or magnesium-manganese alloys.

A silicon-containing, corrosion-resistant magnesium alloy having a fine-grained solidification structure is known from DE 1 433 108 A1. Manganese, zinc, and titanium are added to the magnesium alloy, in addition to silicon, and aluminum, cadmium and silver are added as further alloying components.

Additional alloys containing manganese as well as further elements such as aluminum, copper, iron, nickel, calcium and the like, in addition to magnesium as the main component, are known from DE 199 15 276 A1, DE 196 38 764 A1, DE 679 156, DE 697 04 801 T2, and DE 44 46 898 A1, for example.

The known magnesium alloys have a wide variety of drawbacks.

U.S. Pat. No. 6,544,357 discloses a magnesium and aluminum alloy containing 0.1 or 0.2 wt. % up to 30 or 10 wt. % La, Ce, Pr, Nd, Sm, Ti, V, Cr, Mu, Zr, Nb, Mo, Hf, Ta, W, Al, Ga, Si, B, Be, Ge, and Sb, along with other elements. The range of alloys that could potentially be produced here is so broad and unmanageable that it is impossible for a person skilled in the art to arrive at the alloy that is claimed hereinafter.

In alloys containing magnesium-aluminum-zinc-manganese or magnesium-aluminum-manganese, the strength is reduced at higher temperatures.

The overall metal forming behavior, weldability, or corrosion resistance is degraded.

The cold workability of the most common magnesium alloys is limited due to the hexagonal crystal structure and low ductility. The majority of magnesium alloys exhibit brittle behavior at room temperature. In addition to high tensile strength, a ductile behavior is needed for certain metal forming processes to produce semi-finished products from magnesium alloys. Higher ductility allows improved metal forming and deformation behavior, as well as greater strength and toughness.

Many of the known magnesium alloys have drastically varying properties in the produced state.

A further disadvantage in the production of magnesium alloys is that metallic manganese in the magnesium melt is poorly soluble or requires a long time to dissolve.

SUMMARY OF THE INVENTION

It is the object of the invention to develop a magnesium alloy that is suitable for producing metal sheets, welding wire, profiled extruded sections or components, which is to say, that has good deformation properties, high corrosion resistance, improved weldability, a high yield strength, and good cold workability.

According to the invention, this is achieved by a magnesium alloy comprising at least 84.5 wt. % magnesium, produced by adding 0.4 to 4.0 wt. % cerium, 0.2 to 2.0 wt. % lanthanum, wherein cerium and lanthanum are present at a ratio of 2:1, 0.1 to 5 wt. % of at least one further metal from the group of the rare earths, 1.5 to 3.0 wt. % of a manganese compound, and 0.1 to 1.5 wt. % of a phosphorus compound. Scandium is preferably used as a further metal from the group of the rare earths.

Manganese compounds that may be used include, for example, manganese (II, III) oxides, manganese (II) chlorides, manganese phosphates having an iron content below 0.01 wt. % or manganite.

Mozanites, manganese phosphates or magnesium phosphates can be used as the phosphorus compound.

Phosphorus increases the tensile strength, hardness and corrosion resistance in alloys.

The magnesium alloy has a yield strength (Rp 0.2) of at least 120 Mpa, good strength properties over an extended temperature range, and high creep resistance, with adequate deformability.

The magnesium alloy according to the invention can be used to produce metal sheets, semi-finished products, or extruded components and profiled sections, as well as to produce welding wires. These can then be used to produce specific parts, preferably for use in vehicle construction, train construction, shipbuilding and aircraft construction, such as seat, window or door frames, automotive body shells, housings, carriers, mountings, supports and other small components.

DETAILED DESCRIPTION OF THE INVENTION

A particularly advantageous magnesium alloy for processing on extrusion machines is obtained when the same is produced from aluminum-free magnesium by adding 1.0 wt. % cerium, 0.5 wt. % lanthanum, 0.10 wt. % scandium, and 2.0 wt. % manganese (II) chloride.

A further magnesium alloy is obtained when the same is produced from aluminum-free magnesium by adding 1.0 wt. % cerium, 0.5 wt. % lanthanum, 2.0 wt. % manganese (II) chloride, and 0.1 wt. % monazite.

The alloys having this composition are characterized by good corrosion resistance, an improved cold working behavior, a lower warm creep behavior, and high yield strength.

This magnesium alloy can be used, in particular, to produce metal sheets, profiled extruded sections and components, and for drawn welding wires.

The invention claimed is:

1. An aluminum-free magnesium alloy comprising
at least 84.5 wt. % magnesium,
0.4 to 4.0 wt. % cerium,
0.2 to 2.0 wt. % lanthanum,
0.1 to 5 wt. % of at least one further rare earth metal,
1.5 to 3.0 wt. % of a manganese compound, and
0.1 to 1.5 wt. % of a phosphorus compound.

2. The aluminum-free magnesium alloy according to claim 1, wherein the at least one further rare earth metal is scandium.

3. The aluminum-free magnesium alloy according to claim 1, wherein the manganese compound is a manganese (II, III) oxide.

4. The aluminum-free magnesium alloy according to claim 1, wherein the manganese compound is a manganese (II) chloride.

5. The aluminum-free magnesium alloy according to claim 1, wherein the manganese compound is a manganese phosphate having an iron content of less than 0.01 wt. %.

6. The aluminum-free magnesium alloy according to claim 1, wherein the manganese compound is a manganite.

7. The aluminum-free magnesium alloy according to claim 1, wherein the phosphorus compound is a monazite.

8. The aluminum-free magnesium alloy according to claim 1, wherein the phosphorus compound is a manganese phosphate.

9. The aluminum-free magnesium alloy according to claim 1, wherein the phosphorus compound is a magnesium phosphate.

10. The aluminum-free magnesium alloy according to claim 1 in the form of profiled extruded or diecast sections.

11. The aluminum-free magnesium alloy according to claim 1 in the form of drawn welding wires.

12. The aluminum-free magnesium alloy according to claim 1, comprising approximately
96.3 wt. % magnesium,
1.0 wt. % cerium,
0.5 wt. % lanthanum,
0.1 wt. % scandium,
2.0 wt. % of a manganese compound, and
0.1 wt. % of a phosphorus compound.

* * * * *